United States Patent [19]

Taylor

[11] Patent Number: 4,994,729

[45] Date of Patent: Feb. 19, 1991

[54] REFERENCE VOLTAGE CIRCUIT HAVING LOW TEMPERATURE COEFFICIENT SUITABLE FOR USE IN A GAAS IC

[76] Inventor: Stewart S. Taylor, 16927 NW. Hazelgrove Ct., Beaverton, Oreg. 97006

[21] Appl. No.: 499,732

[22] Filed: Mar. 23, 1990

[51] Int. Cl.[5] ..... G05F 3/20

[52] U.S. Cl. ..... 323/314; 323/907; 307/296.8

[58] Field of Search ..... 323/907, 312, 313, 314, 323/315; 307/296.1, 296.6, 49.1

[56] References Cited

U.S. PATENT DOCUMENTS

| | | | |
|---|---|---|---|
| 4,636,710 | 1/1987 | Stanojevic | 323/314 |
| 4,677,369 | 6/1987 | Bowers et al. | 323/314 |
| 4,686,451 | 8/1987 | Li | 323/313 |
| 4,714,872 | 12/1987 | Traa | 323/314 |

FOREIGN PATENT DOCUMENTS

| | | | |
|---|---|---|---|
| 0920665 | 4/1982 | U.S.S.R. | 323/907 |

OTHER PUBLICATIONS

Crauwels, G. L., IBM Technical Disclosure Bulletin, vol. 19, No. 10, Mar. 1977, pp. 3782–3783.

*Primary Examiner*—Steven L. Stephan
*Assistant Examiner*—Nilay H. Vyas
*Attorney, Agent, or Firm*—Paul S. Angello; Peter J. Meza

[57] ABSTRACT

A solid-state electrical circuit (10) includes a reference diode (D1) and multiple diodes (D3-D14) connected in electrical series to produce a substantially temperature-invariant output reference voltage. The reference diode is characterized by a forward voltage drop ($V_{D1}$) that changes in accordance with a temperature coefficient. The multiple diodes, which have selected junction areas (A1 and A2) and receive one of two different forward-bias currents (I1 and I2), are electrically interconnected to establish a net voltage ($\Delta V_{Di}$) that equals the forward voltage drop across the reference diode and changes in accordance with a net temperature coefficient of substantially equal magnitude but of opposite sign to the temperature coefficient of the reference diode. The output reference voltage equals the sum of the forward voltage drop across the reference diode and the net voltage established by the multiple diodes. The output reference voltage is substantially unaffected by changes in temperature because voltage changes resulting from the two temperature coefficients of opposite sign effectively offset each other. The invention is particularly suitable for implementation in GaAs IC technology.

15 Claims, 1 Drawing Sheet

REFERENCE VOLTAGE CIRCUIT HAVING LOW TEMPERATURE COEFFICIENT SUITABLE FOR USE IN A GAAS IC

TECHNICAL FIELD

The present invention relates to reference voltage generating circuitry and, in particular, to a reference voltage circuit that provides a substantially temperature-invariant output voltage and is particularly well-suited for implementation in gallium arsenide integrated circuit technology.

BACKGROUND OF THE INVENTION

Circuits that produce stable reference voltages are necessary for establishing threshold voltages in data conversion devices, such as digital-to-analog or analog-to-digital converters, or in digital logic circuitry. One reason why stable reference voltages are necessary is that variations in the offset and peak-to-peak voltages of switching signals applied to or developed by such circuits require a stable threshold reference to ensure that a voltage comparator will properly respond to transitions between voltage levels of the switching signal. Two popular logic families include emitter-coupled logic (ECL), which is implemented in silicon integrated circuit (IC) technology, and source-coupled logic, which is implemented in gallium arsenide (GaAs) IC technology. Voltage reference generator techniques suitable for one type of IC may not, however, be suitable for a different type of IC.

A resistive voltage divider and a series-connected diode circuit are two basic voltage reference circuit designs that are unacceptable for use as voltage reference generators in most integrated circuit applications. The resistive voltage divider is unacceptable because the output voltage changes in direct proportion to variations in the supply voltage applied to the voltage divider. The simple series-connected diode circuit is also unacceptable because the diode junction voltage is temperature sensitive, changing in accordance with the well-known temperature coefficient of approximately $-1.5$ mV/°C. to $-2.0$ mV/°C. for silicon diodes and of approximately $-1.0$ mV/°C. to $-1.5$ mV/°C. for GaAs Schottky diodes.

A bandgap reference circuit, such as that described in U.S. Pat. No. 4,714,872 of Traa, is implemented in a silicon IC and uses diodes and an operational amplifier to exploit the stability of the band gap to produce a constant output voltage. To effectively perform, a bandgap circuit requires a high gain, a low offset voltage amplifier, and a predictable base-to-emitter voltage of a bipolar junction transistor (BJT). A bandgap circuit is, however, unsuitable for use with gallium arsenide field effect transistor (GaAsFET) devices because they provide low gain and have a high voltage offset whose value can drift appreciably. (A typical GaAsFET amplifier provides a gain of about 10 and has a 50–100 mV offset that drifts at about 500 $\mu$V/°C. These parameters vary randomly for different GaAsFET devices.)

A voltage reference generator suitable for implementation in GaAsFET IC technology is described in U.S. Pat. No. 4,686,451 of Li et al. The Li et al. circuit uses two pair of Schottky diodes and a pair of depletion-mode metal semiconductor field effect transistor (MESFET) devices that are interconnected to produce a constant reference voltage. A drawback associated with the Li et al. circuit is that the nominal output voltage is sensitive to process parameters, thereby causing relatively large variations in output voltage of circuits produced in different process runs.

SUMMARY OF THE INVENTION

An object of the present invention is, therefore, to provide a voltage reference circuit whose output voltage is insensitive to variations in temperature and power supply voltage and to differences in process parameters.

Another object of the invention is to provide such a circuit that is suitable for implementation in GaAs IC technology.

The present invention is a solid-state electrical circuit that includes multiple diodes arranged in a "wrap-around" configuration and connected in electrical series with a reference diode to produce a substantially temperature-invariant output reference voltage. The reference diode is characterized by a forward voltage drop that changes in accordance with a temperature coefficient. The multiple diodes, which have selected junction areas and receive one of two different forward-bias currents, are electrically interconnected to establish a net voltage that equals the forward voltage drop across the reference diode and changes in accordance with a net temperature coefficient of substantially equal magnitude but of opposite sign to the temperature coefficient of the reference diode. The output reference voltage equals the sum of the forward voltage drop across the reference diode and the net voltage established by the multiple "wraparound" diodes. The output reference voltage is substantially unaffected by changes in temperature because voltage changes resulting from the two temperature coefficients of opposite sign effectively offset each other. The ability to use diodes in the absence of operational amplifiers makes the invention particularly suitable for implementation in GaAs IC technology.

Additional objects and advantages of the present invention will be apparent from the detailed description of a preferred embodiment thereof, which proceeds with reference to the accompanying drawings.

DETAILED DESCRIPTION OF PREFERRED EMBODIMENT

Figure 1:
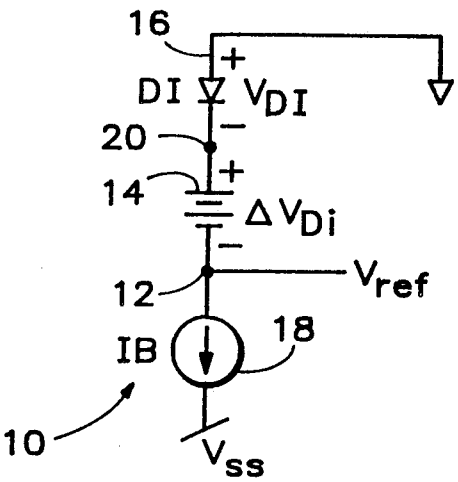
FIG. 1 is a simplified equivalent circuit for explaining the operation of the reference voltage circuit of the present invention.

With reference to FIG. 1, reference voltage circuit 10 of the present invention provides at a reference node 12 a reference voltage, $V_{ref}$, of a nominal value that changes relatively slightly as a function of changes in temperature. Circuit 10 represents a preferred embodiment of a circuit that produces $V_{ref}$ as a threshold voltage in a source-coupled logic circuit. In this implementation, $V_{ref} = -1.3$ V and deviates by typically less than $\pm 20$ mV in response to changes in temperature of greater than $\pm 50°$ C.

Circuit 10 includes a reference diode D1 connected in electrical series with multiple diodes that have selected junction areas and operating currents and are electrically interconnected to establish a net voltage value, which is represented in FIG. 1 by a DC voltage source 14. The anode terminal 16 of reference diode D1 is connected to ground potential, and a current source 18 receives a bias voltage from a power supply, $V_{ss}$, to develop a current, IB, that flows through reference diode D1 and DC voltage source 14. The voltage developed at node 12 may be expressed as $$V_{D1}+\Delta V_{Di}=C_o, \quad (1)$$

where $V_1$ is the forward voltage drop across D1, $\Delta V_{D1}$ is the net forward voltage drop across the diodes represented by voltage source 14, and $C_o$ is a constant.

In a preferred embodiment, $V_{D1}=\Delta V_{Di}=650$ mV, which develops $V_{ref}=-1.3$ V at reference node 12. The voltage, $V_{D1}$, changes in accordance with the temperature coefficient of reference diode D1, and the voltage, $\Delta V_{Di}$, changes in accordance with the net temperature coefficient of the diodes represented by voltage source 14. The diodes represented by voltage source 14 establish a net voltage that approximately equals the value of $V_{D1}$, and a net temperature coefficient of substantially equal magnitude but of opposite sign to the magnitude and sign of the temperature coefficient of reference diode D1. The reference voltage, $V_{ref}$, remains constant with temperature because temperature-induced changes in $V_{D1}$ are offset by temperature-induced changes in $\Delta V_{Di}$.

Figure 2:
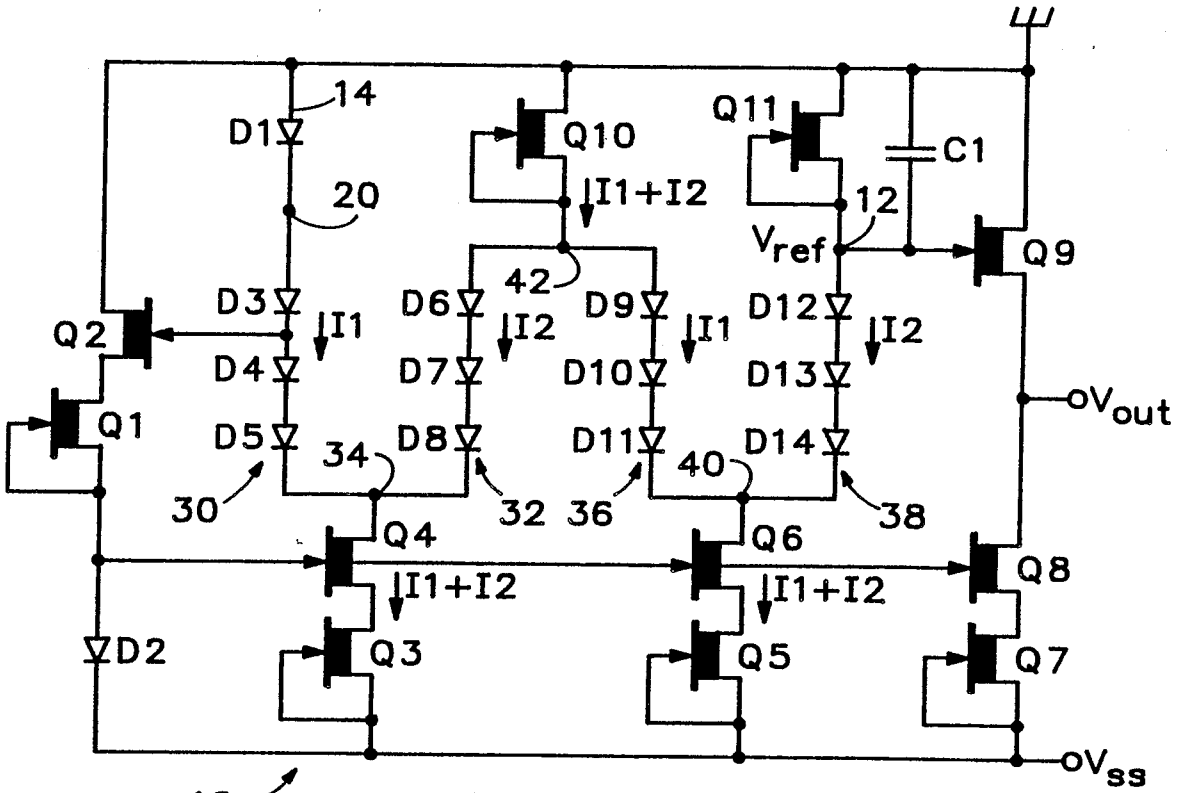
FIG. 2 is a schematic diagram of the reference voltage circuit of the present invention.

With reference to FIG. 2, circuit 10 includes reference diode D1 and two loops of diodes, D3–D14, of opposing polarities and selected diode junction areas and bias currents to develop the potential difference, $\Delta V_{Di}$. Diodes D1 and D3–D14 are of the Schottky type.

The diodes D3–D14 forming voltage source 14 are divided into first and second sets of six diodes, the first set including diodes D3, D4, D5, D9, D10, and D11 and the second set including diodes D6, D7, D8, D12, D13, and D14. The first set of diodes D3–D5 and D9–D11 conducts a first current I1 and have a first diode junction area, Al; and the second set of diodes D6–D8 and D12–D14 conducts a second current I2 and have a second diode junction area, A2. The current ratio, 11/12, and the area ratio, A2/A1, of diodes D3–D14 produce the difference voltage $\Delta V_{Di}$, as will be further described below.

To realize a practical circuit design for circuit 10 to which $V_{ss}=-4.5$ to $-5.5$ V is applied, the first and second sets of diodes are subdivided into four separate branches of three series-connected diodes, with a branch of diodes of the first set being connected in series in opposite polarity to a branch of diodes of the second set. More specifically, a branch 30 of diodes D3–D5 of the first set are connected to a branch 32 of diodes D6–D8 of the second set so that the current I1 flowing through branch 30 and the current I2 flowing through branch 32 flow into a node 34. Similarly, a branch 36 of diodes D9–D11 of the first set are connected to a branch 38 of diodes D12–D14 of the second set so that the current I1 flowing through branch 36 and the current I2 flowing through branch 38 flow into a node 40. Branches 32 and 36 are connected together at a node 42 to complete the series connection of the four branches of diodes. The currents I1 and I2 are supplied by current source transistors Q3, Q5, Q10, and Q11 that operate in a manner described below.

The potential difference, $\Delta V_{Di}$, developed between node 12 and node 20 equals the sum of the potential difference between node 20 and node 42 and the potential difference between node 42 and node 12. Because of the symmetry of the junction areas and bias currents flowing through the diodes in branches 30 and 36 and in branches 32 and 38, the potential difference between node 42 and node 12 is the same as the potential difference between node 20 and node 42, the latter of which potential differences is derived as follows.

In accordance with Kirchoff's voltage law, the potential difference developed between node 20 and node 42 equals $$\Delta V_{20\text{-}42}=3V_{D6}-3V_{D3}, \quad (2)$$

where $V_{D3}$ is the voltage across the forward-biased diode D6 and $V_{D3}$ is the voltage across the forward-biased diode D3. Equation (2) is valid under the assumption that diodes D3–D5 are identical with one another and diodes D6–D8 are identical with one another.

Substituting into equation (2) the well-known expression for the current flowing through a forward-biased diode $$\left(V_D=\eta\frac{kT}{q}\ln\left(\frac{IB}{IS}\right)\right)$$

recasts equation (2) as $$\Delta V_{20-42}=3\eta\frac{kT}{q}\ln\left(\frac{I1}{IS1}\right)-3\eta\frac{kT}{q}\ln\left(\frac{I2}{IS2}\right) \quad (3)$$

where $\eta$ is an ideality factor (which equals about 1.16), k is Boltzman's constant (which equals $1.3\times10^{-23}$ watt-second /°C.), T is the temperature in degrees Kelvin, q is the charge on an electron (which equals $1.6\times10^{19}$ coulomb), T1 and I2 are the currents flowing through the respective diode branches 30 and 32, IS1 is the saturation current of each of the diodes D3–D5 of branch 30, and IS2 is the saturation current of each of the diodes D6–D8 of branch 32. (The saturation current is defined as the reverse-bias leakage current of a diode and is proportional to the diode junction area.)

The ratio IS2/IS1 in equation (3) can be expressed as A2/A1, which is the ratio of the junction area, A2, of diode D6 and the junction area, Al, of diode D3. Substituting the ratio A2/A1 and manipulating the logarithmic term of equation (3) provides $$\Delta V_{20-42}=3\eta\frac{kT}{q}\ln\left(\frac{I1}{I2}\times\frac{A2}{A1}\right) \quad (4)$$

The logarithmic term in equation (4) represents a constant value for the parameters specified in a given circuit design; therefore, equation (4) can be expressed as $$\Delta V_{20-42}=3\eta\frac{kT}{q}C_1, \quad (5)$$

where $C_1=\ln(I1/I2\times A2/A1)$. Equation (5) indicates that the potential difference between node 20 and node 42 increases with increasing temperature; whereas, the voltage across the forward-biased diode D2 decreases as a function of increasing temperature.

The potential difference between node 20 and node 12, $\Delta V_{Di}$, may be expressed as $$\Delta V_{Di} = \Delta V_{20-42} + \Delta V_{42-12} = 2\Delta V_{20-42} = 6\eta \frac{kT}{q} C_1, \quad (6)$$

where $\Delta V_{42\text{-}12}$ is the potential difference between node 42 and node 12. In a preferred embodiment, the area of diode D1 and the bias current I1 is chosen to produce a voltage, $V_{D1}$, of approximately 650 mV, and the areas A1 and A2 and the currents I1 and I2 are chosen to produce a total difference in diode voltage, $\Delta V_{Di}$, of approximately 650 mV. The current density in each of the diodes D1 and D3–D14 is selected to keep the ohmic voltage drop less than 10 mV. The temperature coefficient of $V_{D1}$ and that of $\Delta V_{Di}$ developed by diodes D3–D14 are, therefore, approximately equal and opposite with an absolute value of about 1.5 mV/°C.

The reference voltage, $V_{ref}$, stays relatively constant with changes in temperature. As indicated by equation (4), the initial spread in reference voltage $V_{ref}$ is determined by $V_{D1}$ and by the ratios of the areas of diodes D3–D14 and of the current source transistors that produce current Il and I2. These ratios can be maintained to a typical accuracy of a few percent by using multiple identical devices. Mismatches in the ratio A2/A1 or I1/I2 produce relatively small changes in reference voltage $V_{ref}$ because such mismatches affect the voltage as a logarithmic function. For example, a 5% mismatch in I1/I2 causes only a 9 mV error.

The channel lengths of Q3, Q5, Q10, and Q11 preferably range from 5 to 20 microns to improve the matching of such transistors and to raise their output impedance. FETs having such relatively long channel lengths operate at lower current levels and thereby save power and facilitate keeping the current density low in diodes D1 and D3–D14. The minimum widths and lengths of the diode junctions and the FET channels are chosen to be relatively large (typically at least 3 microns) to enhance matching. Typical values for the preferred embodiment of circuit 10 are M/L=10/3 microns for each of the diodes D1 and D3–D14 and W/L=20/3 microns for each of the current-source transistors Q3, Q5, Q10, and Q11. A typical current ratio is I1/I2=5, and a typical area ratio is A2/A1=6.

The currents I1 and I2 flowing through diode branches 30, 32, 36, and 38 are produced as follows. Transistors Q3, Q5, and Q10 are connected as current sources that provide a net current, I1+I2, to node 34, node 40, and node 42, respectively. Transistors Q3 and Q5 are typically implemented with a multiplicity of identical transistors to achieve the desired ratio of currents I1 and I2 in an accurate way. Transistor Q11 is connected as a current source to provide the current I2 to node 12. Transistors Q4 and Q6 are connected in a cascode configuration with the respective transistors Q3 and Q5. Transistors Q4 and Q6 raise the effective output impedances of the respective transistors Q3 and Q5 and thereby prevent a significant change in their drain-to-source voltages in response to changes in the value of the power supply, $V_{ss}$. Transistors Q1 and Q2 are connected in a cascode configuration to provide a bias current for a diode D2, across which develops a suitable bias voltage for the gate terminals of transistors Q4, Q6, and Q8.

Transistors Q7 and Q8 are connected in a cascode configuration to provide a current source for a source follower transistor Q9, which receives at its gate terminal the reference voltage, $V_{ref}$, and provides a buffered version of $V_{ref}$ at its source terminal, $V_{out}$. An optional capacitor, C1, provides a high frequency signal bypass path for suppressing switching transients that might appear on $V_{ref}$ at node 12.

It will be appreciated that the "wraparound" configuration of the four diode branches 30, 32, 36, and 38 each of which having three series-connected diodes to establish $\Delta V_{Di}$ accommodates the use of a power supply, $V_{ss}$, of about −5 V. The present invention can be implemented, however, with a different number of diode branches having a different number of diodes to accommodate the use of power supplies of different voltage magnitudes. The present invention may also be adapted to a circuit design in which anode terminal 16 of reference diode D1 is not referenced at ground potential.

It will be obvious to those having skill in the art that many changes may be made in the above-described details of the preferred embodiment of the present invention without departing from the underlying principles thereof. For example, more than one reference diode and additional "wraparound" diodes can be used in circuit 10 to provide a different $V_{ref}$ at node 12. The scope of the present invention should, therefore, be determined only by the following claims.

I claim:

1. A method of providing a reference voltage circuit having a low temperature coefficient, comprising:

providing a first reference voltage that changes in accordance with a first temperature coefficient of predetermined magnitude and sign;

providing multiple series-connected forward-biased diodes including GaAs Schottky diodes having different junction areas and conducting forward-bias electrical current of different values to establish a second reference voltage that changes in accordance with a second temperature coefficient of substantially equal magnitude but of opposite sign to the magnitude and sign of the first temperature coefficient; and superimposing the first and second reference voltages to develop a substantially temperatureinvariant voltage that corresponds to the sum of the first and second reference voltages.

2. The method of claim 1, in which the first and second voltage values are substantially the same.

3. The method of claim 1, in which the first reference voltage is established by a forward-biased diode.

4. The method of claim 1, in which the reference voltage circuit is implemented in integrated circuit form.

5. A reference voltage circuit having a low temperature coefficient, comprising:

first and second series-connected reference voltage means for providing a substantially temperature invariant output voltage, the first reference voltage means providing a first reference voltage that changes in accordance with a first temperature coefficient of predetermined magnitude and sign and the second reference voltage means including first and second sets of multiple diodes, each of the diodes of the first set having first diode junction dimensions and conducting a first electrical current and each of the diodes of the second set having second diode junction dimensions and conducting a second electrical current, the first and second sets of diodes being connected in series such that the net voltage developed across the series-connected diodes for providing a second reference voltage that changes in accordance with a second temperature coefficient substantially of equal magnitude but of opposite sign to the magnitude and sign of the first temperature coefficient, whereby the first and second temperature coefficients offset each other so that the output voltage is substantially constant.

6. The circuit of claim 5, in which the first and second reference voltages are substantially the same.

7. The circuit of claim 3, in which the first and second sets of diodes develop respective first and second potential differences of equal magnitudes.

8. The circuit of claim 6, in which the first set of diodes includes first and second branches of series-connected diodes and the second set of diodes includes third and fourth branches of series-connected diodes, the first and second branches conducting the first electrical current and the third and fourth branches conducting the second electrical current.

9. The circuit of claim 8, in which the first and third branches join at an electrical node through which a current representing the sum of the first and second currents flows and the second and fourth branches join at a different electrical node through which a current representing the sum of the first and second currents flows.

10. The circuit of claim 8, in which the second and third branches join at an electrical node through which a current representing the sum of the first and second currents flows.

11. The circuit of claim 8, in which the first, second, third, and fourth branches have the same number of diodes.

12. The circuit of claim 7, in which the first and second diode junction dimensions define respective first and second diode junction areas that differ from each other.

13. The circuit of claim 7, in which the first reference voltage means includes a reference diode.

14. The circuit of claim 7, in which the diodes are of the GaAs Schottky type.

15. The circuit of claim 5, in which the reference voltage circuit is implemented in integrated circuit form.

* * * * *